US007565992B2

(12) United States Patent
Buetow

(10) Patent No.: US 7,565,992 B2
(45) Date of Patent: Jul. 28, 2009

(54) COLLAPSIBLE PROTECTIVE TIP FOR FASTENER DRIVER WORKPIECE CONTACT ELEMENT

(75) Inventor: Robert S. Buetow, Lake In The Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/805,341

(22) Filed: May 23, 2007

(65) Prior Publication Data

US 2008/0290128 A1 Nov. 27, 2008

(51) Int. Cl.
*B21J 15/28* (2006.01)

(52) U.S. Cl. ..... 227/110; 227/156; 227/123

(58) Field of Classification Search ..... 227/156, 227/110, 123
See application file for complete search history.

(56) References Cited

U.S. PATENT DOCUMENTS 3,443,714 A * 5/1969 Edwards ..... 220/671
3,850,361 A * 11/1974 Day et al. ..... 229/400
4,272,019 A * 6/1981 Halaby, Jr. ..... 239/8
4,420,214 A * 12/1983 Wu ..... 439/620.31
4,422,130 A * 12/1983 Nomura ..... 362/183
4,550,854 A * 11/1985 Schellenberg ..... 220/62.2
4,618,740 A * 10/1986 Ray et al. ..... 174/67
4,821,937 A * 4/1989 Rafferty ..... 227/8
4,904,827 A * 2/1990 Potter et al. ..... 174/136
5,219,110 A * 6/1993 Mukoyama ..... 227/8
5,261,587 A 11/1993 Robinson
5,263,626 A * 11/1993 Howard et al. ..... 227/8
5,423,689 A * 6/1995 Valentino ..... 439/141
5,809,851 A * 9/1998 Thompson ..... 81/124.2
5,927,163 A * 7/1999 Habermehl et al. ..... 81/434
6,016,946 A * 1/2000 Phillips et al. ..... 227/10
D483,225 S * 12/2003 Gain ..... D7/512
6,783,044 B2 * 8/2004 Perra et al. ..... 227/8
6,959,850 B2 * 11/2005 Taylor et al. ..... 227/8
7,041,905 B1 * 5/2006 Stewart ..... 174/67
7,172,451 B1 * 2/2007 Ratzlaff ..... 439/346
7,175,063 B2 * 2/2007 Osuga et al. ..... 227/8
7,320,613 B1 * 1/2008 Ratzlaff ..... 439/345
2005/0189390 A1 * 9/2005 Taylor et al. ..... 227/8
2005/0189396 A1 * 9/2005 Leasure et al. ..... 227/130
2005/0194421 A1 9/2005 Smolinski et al.
2005/0255201 A1 * 11/2005 Gruhot et al. ..... 426/115
2006/0016719 A1 * 1/2006 Cassese et al. ..... 206/564
2006/0196682 A1 9/2006 McGee et al.
2006/0291826 A1 * 12/2006 Hafer et al. ..... 392/395
2007/0057006 A1 3/2007 Moore et al.

* cited by examiner

*Primary Examiner*—Brian D Nash
(74) *Attorney, Agent, or Firm*—Greer, Burns & Crain, Ltd.; Christopher P. Rauch; Mark W. Croll

(57) ABSTRACT

A collapsible protective tip for a fastener driver workpiece contact element includes a body having an insertion end configured for receiving the workpiece contact element and a substrate contact end, and at least one locator nub projects from the substrate contact end.

14 Claims, 5 Drawing Sheets

COLLAPSIBLE PROTECTIVE TIP FOR FASTENER DRIVER WORKPIECE CONTACT ELEMENT

BACKGROUND OF THE INVENTION

The present invention relates generally to fastener driving tools, also referred to as fastener drivers, whether powered by pneumatic, electrical, combustion, powder or other power sources. More specifically, the present invention relates to fastener drivers used in applying trim such as baseboards, chair rails and corner molding, in furniture construction, or in other applications where fastener driving accuracy is needed.

In conventional fastener drivers, the user typically places a workpiece contact element, also referred to in the art as a wire form, nosepiece, push rod and other terms, against a substrate intended to receive a fastener. In some tools, typically pneumatic or combustion-powered, a pressing action of the tool against the substrate triggers internal tool functions required for completing the fastener driving operation. Depending on the configuration of the particular tool, the user may find that the specific workpiece is obscured by portions of the tool, including but not limited to the workpiece contact element. As such, the accuracy of fastener placement is variable depending on the tool configuration.

In trim applications, including but not limited to application of wooden molding in construction, such as baseboards, corner molding, chair rails and the like, fastener location is more critical, in that applicators prefer that the fasteners are located in intended locations (typically over support studs) and also that the fasteners are relatively obscured or less visible upon completion of the installation. However, the construction of conventional fastener drivers has often interfered with accurate fastener location to the level required by trim applicators.

Another design factor of fastener drivers for trim applications is that the workpiece contact element is typically metal, often with sharp tips for securely engaging the workpiece. In some cases, this construction has caused unwanted marks in the workpiece which often require subsequent repair or, in severe circumstances, replacement of the trim.

Thus, there is a need for an improved fastener driver which more accurately locates the fastener location than conventional tools. There is also a need for an improved fastener driver which reduces the opportunity for workpiece contact elements to cause damage to the workpiece.

BRIEF SUMMARY OF THE INVENTION

The above-listed needs are met or exceeded by the present collapsible protective tip for a fastener driver workpiece contact element. The present tip is made of a resilient, scratch-resistant material to avoid damaging the workpiece. In addition, the present tip includes at least one locator nub for achieving consistent fastener location, particularly in applications where the trim or molding is provided with a concave shape or groove. To promote versatility of the present tip, the locator nubs are collapsible, so that prior to fastener application, especially if the workpiece is substantially planar, the tip generally conforms to the workpiece surface. Furthermore, the present tip is readily removable from the tool's workpiece contact element to permit conventional use.

More specifically, the present collapsible protective tip for a fastener driver workpiece contact element includes a body having an insertion end configured for receiving the workpiece contact element and a substrate contact end, and at least one locator nub projects from the substrate contact end.

In another embodiment, a collapsible tip for a fastener driver workpiece contact elements includes a body having an insertion end configured for receiving the workpiece contact element, and a substrate contact end including a substrate contact surface. A pair of spaced pod formations on the body are generally adjacent the substrate contact surface. The pod formations define a fastener driving location therebetween. At least one locator nub projects from each substrate contact end.

In yet another embodiment, a collapsible tip is provided for a fastener driver workpiece contact element having at least one rod-like end. The tip includes a generally tubular body having an insertion end configured for receiving a corresponding one of the ends of the workpiece contact element and a substrate contact end, and at least one collapsible locator nub projecting from the substrate contact end.

BRIEF DESCRIPTIONS OF THE SEVERAL VIEWS OF THE DRAWINGS

DETAILED DESCRIPTION OF THE INVENTION

Figure 1:
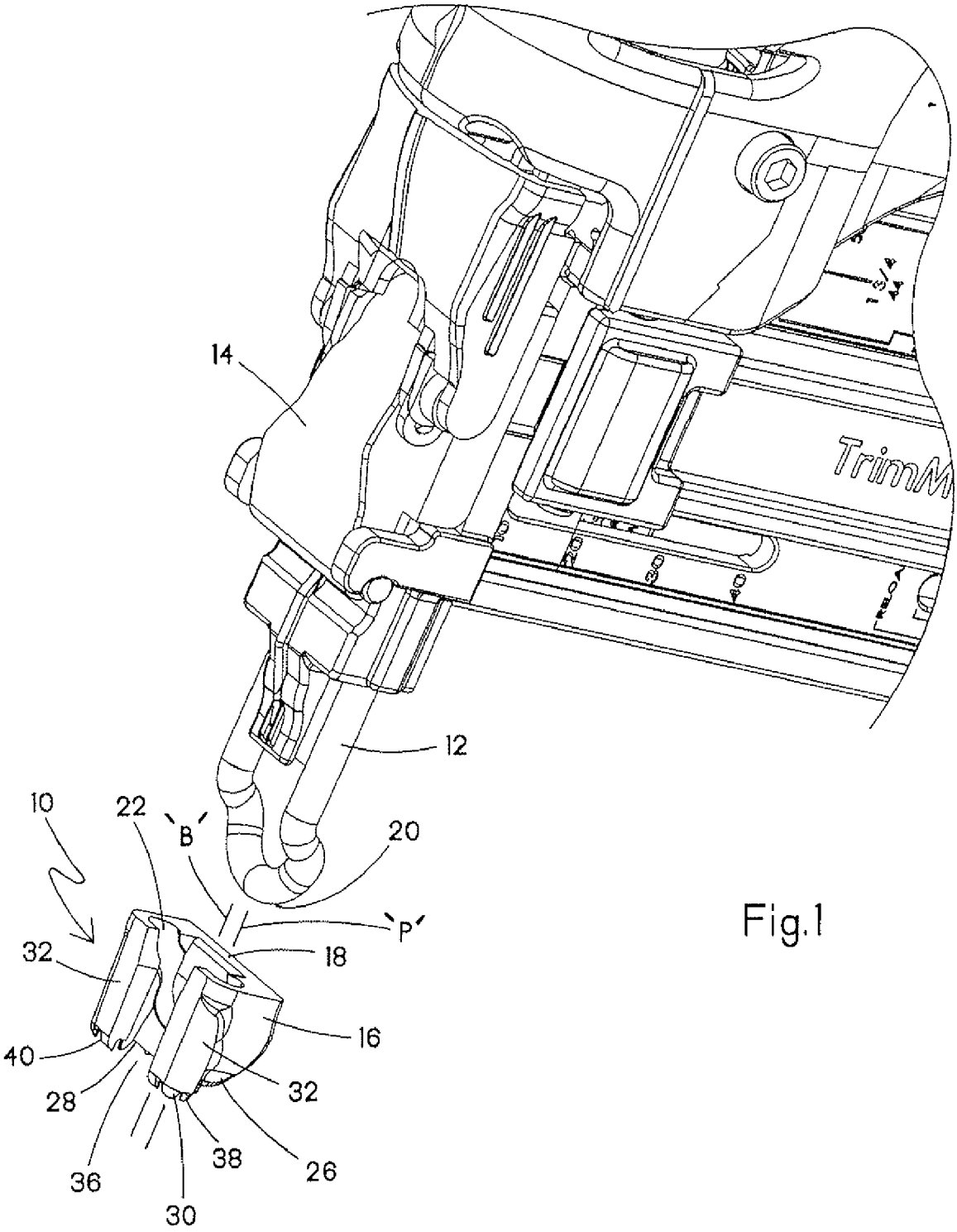
FIG. 1 is an exploded fragmentary top perspective view of a fastener driver equipped with the present locator tip.

Referring now to FIG. 1, the present locator tip for a fastener driver workpiece contact element is generally designated 10. The present tip 10 is preferably configured for releasable attachment to a workpiece contact element 12 of a fastener driver or tool 14. It will be understood that the present tip 10 can be used with a variety of types of fastener drivers 14, including but not limited to those powered by pneumatic, electric, combustion, powder or other sources, as long as they are equipped with a reciprocating workpiece contact element 12 that retracts relative to the driver 14 just prior to driving a fastener into a workpiece. Also, in view of the variety of applicable fastener drivers 14, the term "workpiece contact element" will be understood to refer to a variety of structures used in such tools for contacting the substrate for the purposes of driving a fastener. Such structures are known in the art, for example as wire forms, nosepieces, push rods, and the like. While some of the structures are unitary, some involve movement of one component relative to another.

Referring now to FIGS. 1-4, a body 16 of the locator tip 10 is generally block-shaped, and is made of a resilient rubber or rubber-like material. A wide variety of acceptable self-supporting yet flexible materials are commercially available. Included on the body 16 is an insertion end 18 configured for receiving a corresponding end 20 of the workpiece contact element 12, which is depicted as a wire form as used on a conventional combustion-powered fastener driver. The insertion end 18 defines a cavity 22 which receives and conforms to the end 20 of the workpiece contact element 12 and releasably secures the body 16 to the element. While many shapes are contemplated, the depicted cavity 22 is generally "U"-shaped and is open, forming a half-pipe accommodating the generally cylindrical wire form. Also, locking formations 24 (FIG. 4) preferably integral with the body 16, retain the workpiece end 20 in a snap-type friction fit relationship.

Preferably opposite the insertion end 18 is a substrate contact end 26, which includes a bottom surface or substrate contact surface 28 offset from the bottom of the workpiece end 20 by a distance "D" (FIG. 4), as well as at least one locator nub 30 projecting from the substrate contact end. While other configurations are contemplated, each locator nub 30 is integral with a corresponding generally rod-like pod formation 32 on the body 16 extending generally parallel to the axis of the workpiece contact element 12 so that each nub 30 is generally adjacent the substrate contact surface 28.

Figure 2:
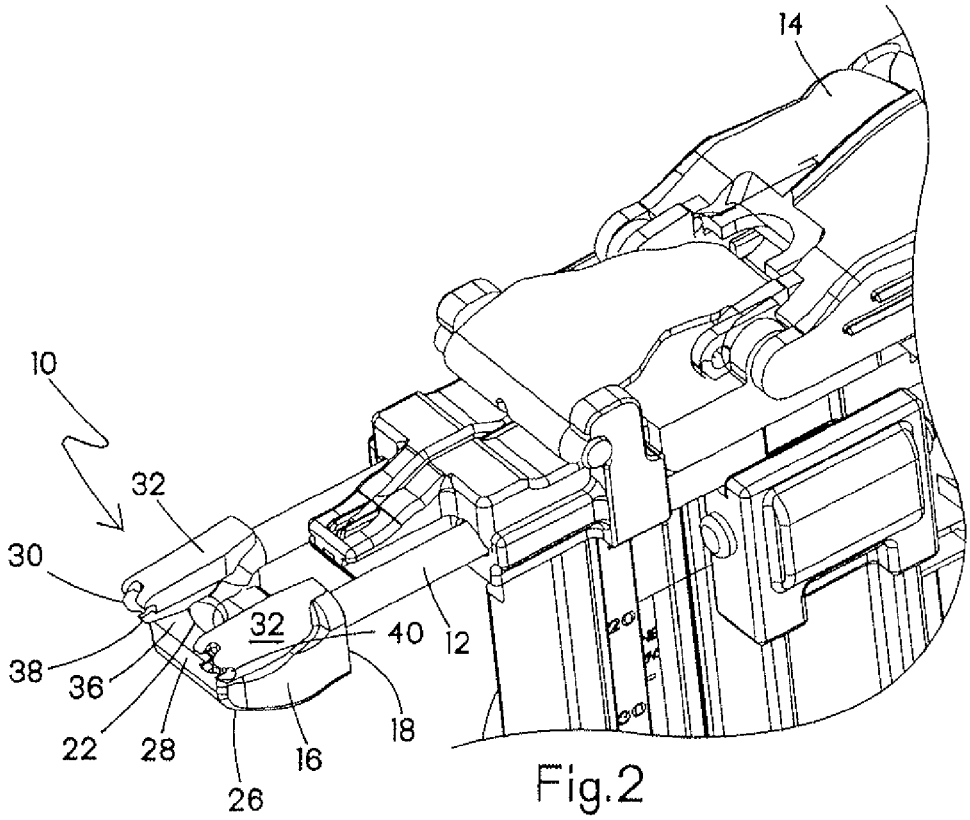
FIG. 2 is a fragmentary perspective view of the present locator tip installed on a fastener driver.
Figure 3:
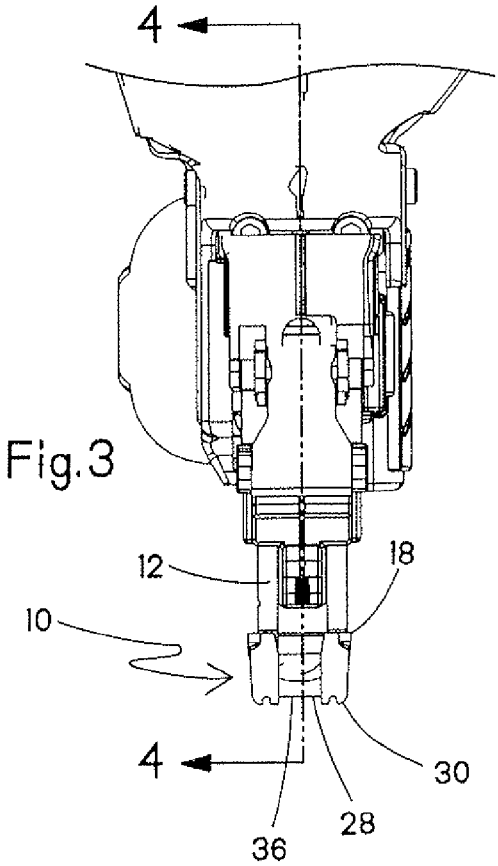
FIG. 3 is a fragmentary front elevational view of the tool of FIG. 2.
Figure 4:
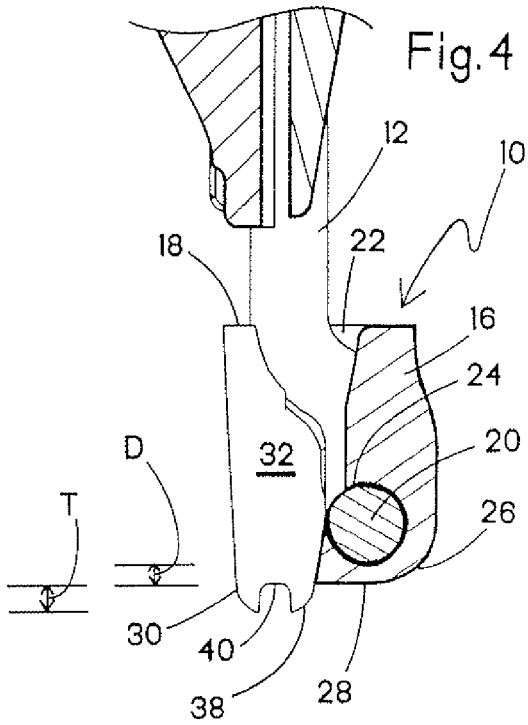
FIG. 4 is a cross-section taken along the line 4-4 of FIG. 3 and in the direction indicated generally.
Figure 7:
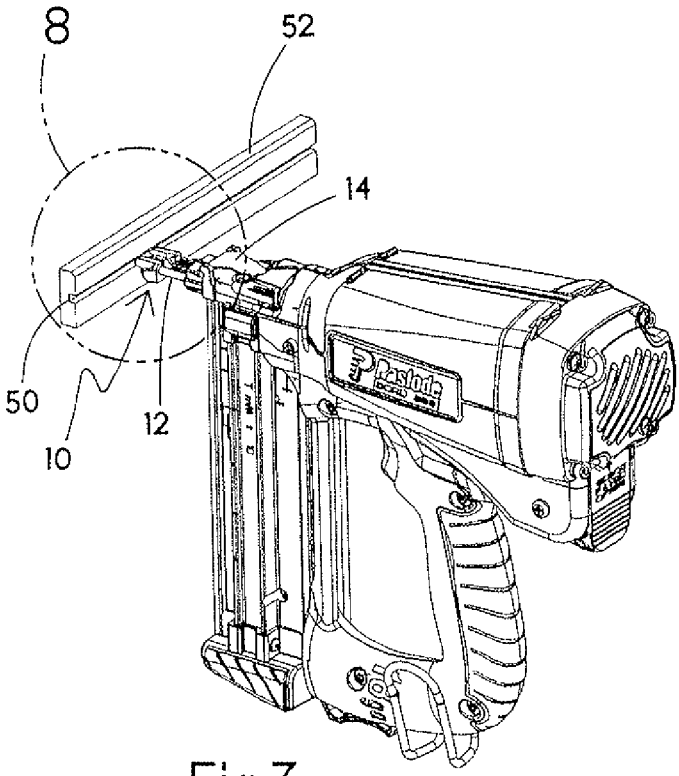
FIG. 7 is a perspective view of a fastener driver equipped with the present locator tip engaged with a piece of molding.

In the preferred embodiment there is a pair of the pod formations 32 in spaced parallel orientation to each other, each formation 32 having a corresponding locator nub 30 secured or integrally formed at a free end 34 of the corresponding pod formation. Also, the pod formations 32 extend along an axis which is transverse to the substrate contact surface 28. The pod formations 32 position the locator nubs 30 to extend past the substrate contact surface 28 (FIG. 4). Also, the pod formations 32 define a fastener driving location 36 therebetween, which facilitates placement of a fastener when both locator nubs 30 are aligned with a trim member (FIG. 7). As seen in FIG. 2, the pod formations 32 and the substrate contact surface 28 form a general "U"-shape when viewed from the workpiece. In other words, at least one of the locator nubs 30 is disposed on the body 16 along an axis "P" which is in spaced, generally parallel relationship to an axis "B" (FIG. 1) of the body supporting the substrate contact surface 28.

Figure 5:
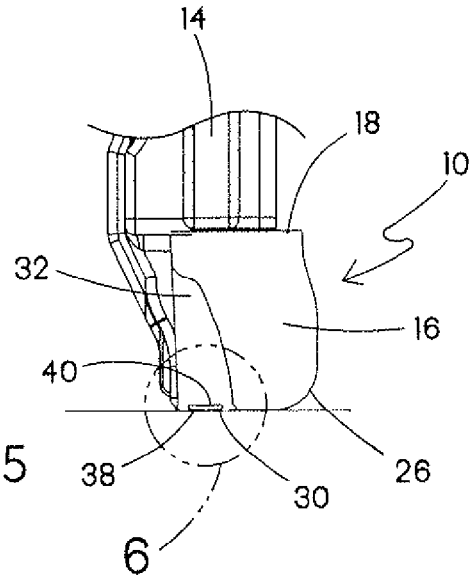
FIG. 5 is a fragmentary side view of the present locator tip shown in a collapsed position prior to fastener driving.
Figure 6:
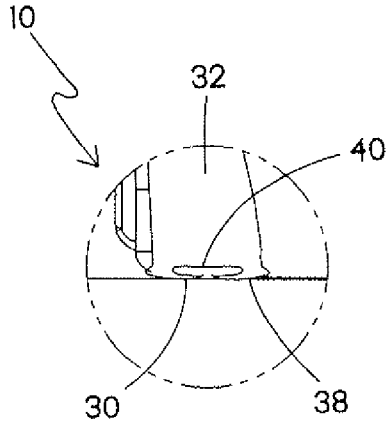
FIG. 6 is an enlarged fragmentary side view of the tip of FIG. 5.
Figure 13:
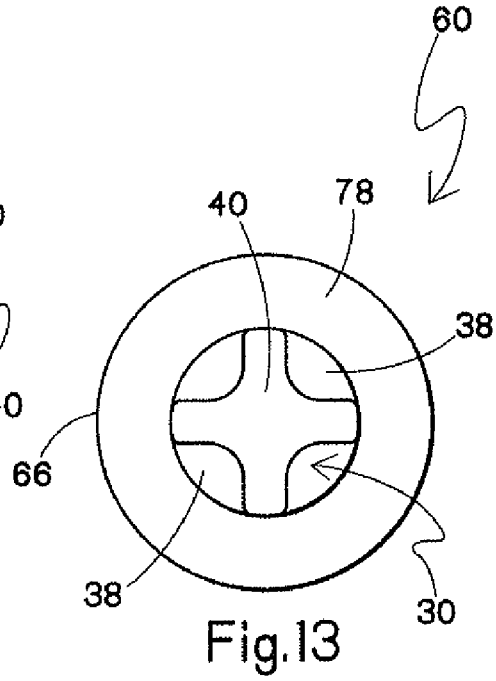
FIG. 13 is a front elevation of the locator tip of FIG. 9.

Referring now to FIGS. 4-6, each of the locator nubs 30 is collapsible so that once positioned, the depth-of-drive adjustment of the fastener driver 14 is maintained despite the added axial length of the locator 10. The nubs 30 are designed so that they can collapse a distance "T" (FIG. 4) up to the substrate contact surface 28. In the preferred embodiment, the collapsibility is provided by making the locator 10 of the above-described rubber-like material, and also by configuring the nubs 30 with a castellated construction. The castellated construction is provided in the form of a plurality, preferably four spaced collapsible lugs 38 separated by an "X" or cross shaped surface 40 (FIG. 13) which is generally coplanar with the substrate contact surface 28. To facilitate location of the lugs 38 into concave trim surfaces, each lug has a generally convex exterior surface.

Figure 8:
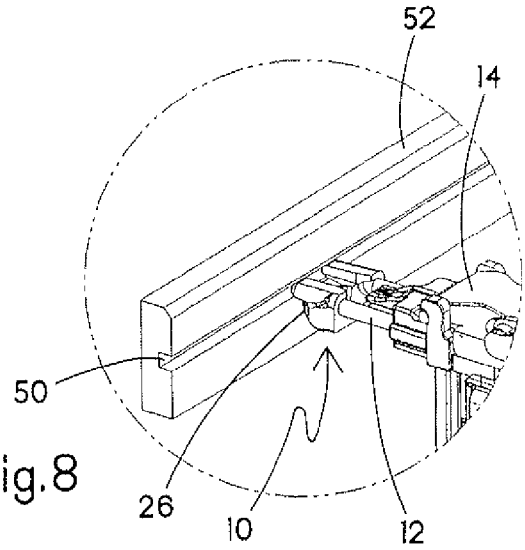
FIG. 8 is a fragmentary enlarged perspective view of the tip of FIG. 7.
Figure 9:
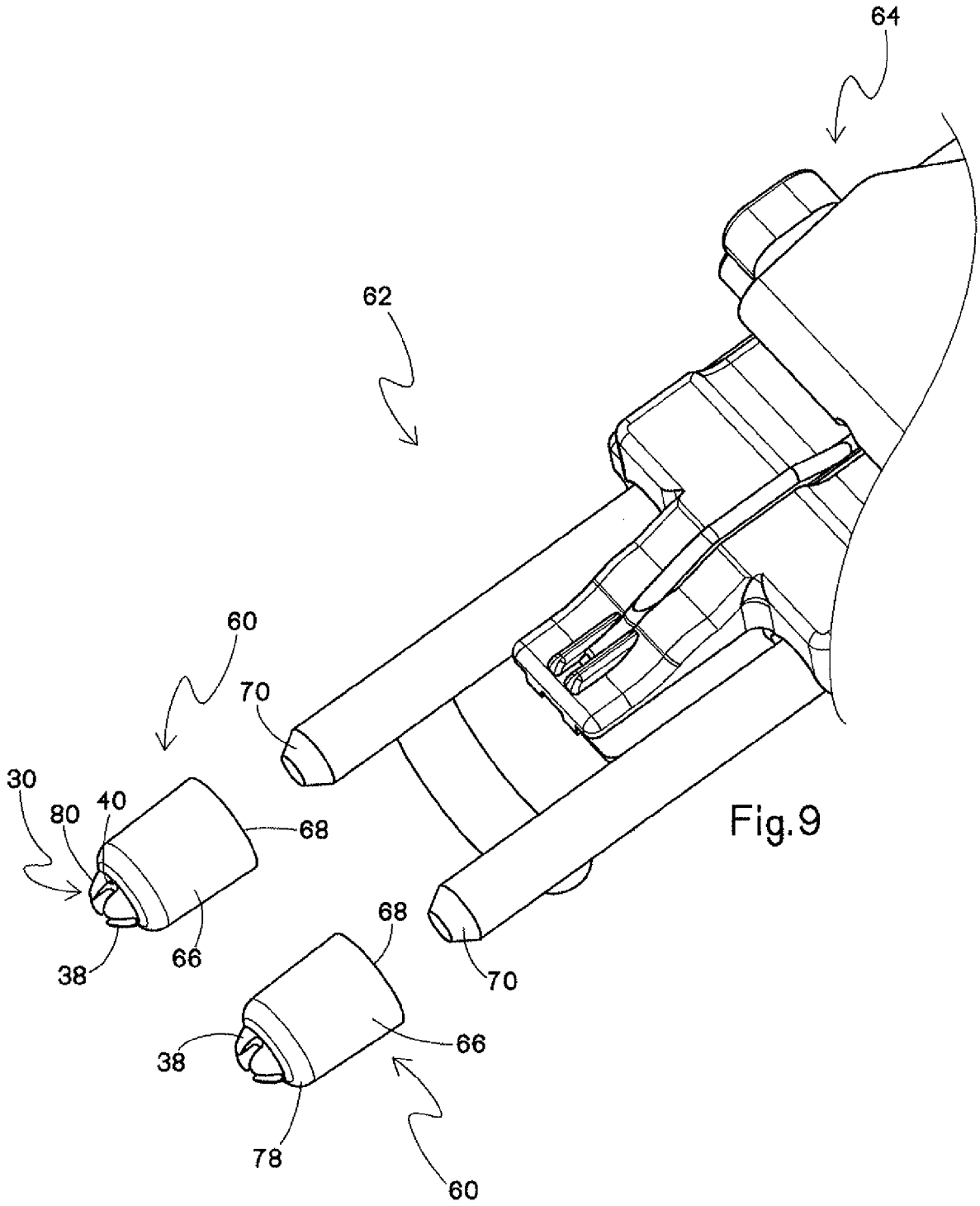
FIG. 9 is an exploded fragmentary top perspective view of an alternate embodiment of the present locator tip mounted on an alternate type of fastener driver.
Figure 10:
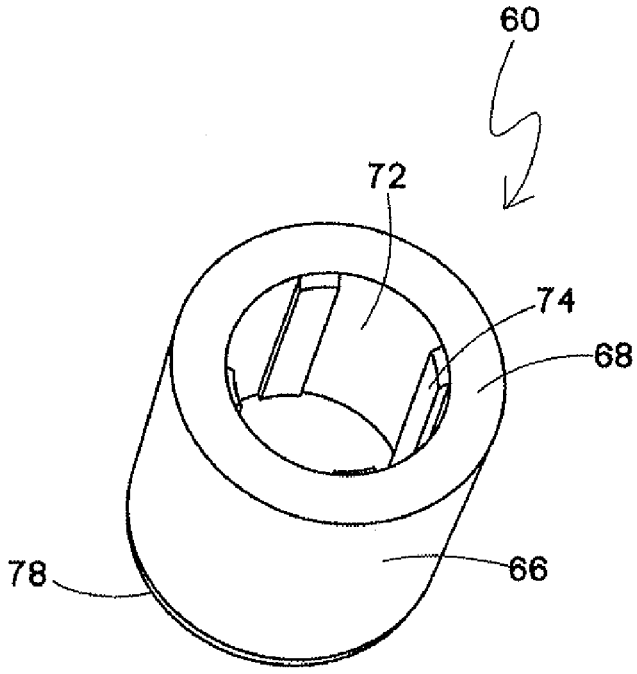
FIG. 10 is a rear perspective view of the locator tip of FIG. 9.
Figure 11:
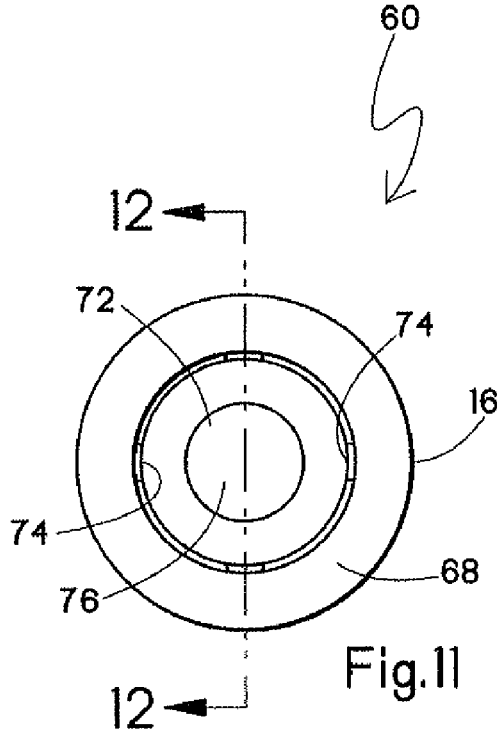
FIG. 11 is a rear elevation of the locator tip of FIG. 9.
Figure 12:
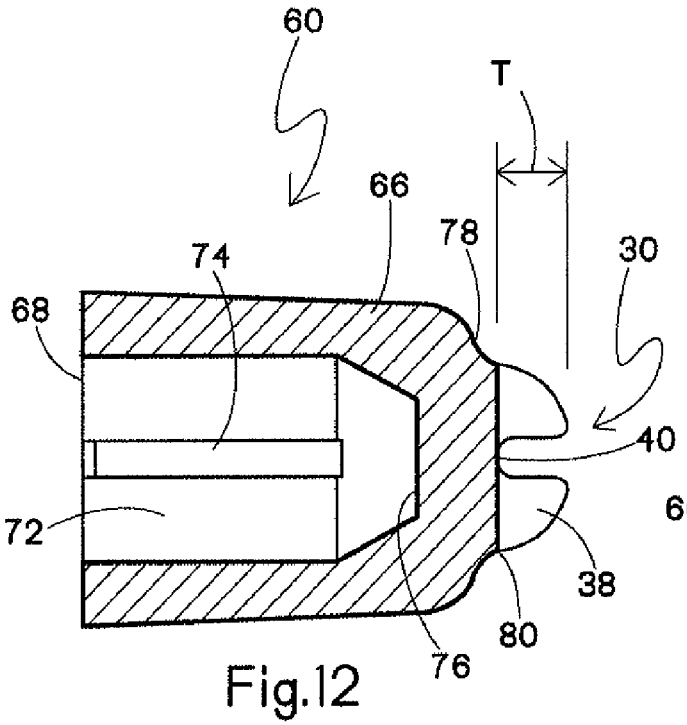
FIG. 12 is a cross-section taken along the line 12-12 of FIG. 11 and in the direction indicated generally.

Referring now to FIGS. 7 and 8, the present tip 10 allows users to locate fasteners more precisely in tracks, grooves, or other concave structures 50 in trim pieces 52. The pair of locating nubs 30 allows the user to slide or locate the workpiece contact element 12 at the desired fastener location in the structure 50 with the fastener driving location 36 centered between the nubs 30. In the provision of the present nubs 30, the tool 14 will lose approximately 0.04 inch of depth of drive. If full depth of drive is needed, the nubs 30 are constructed and arranged to be collapsible, so that the tool 14 can regain lost depth of drive control. Upon the collapse of the nubs 30, a lower end of the tip generally corresponds to the lower end of the conventional workpiece contact element.

In applications where the fastener driver 14 is used on generally planar substrates, the collapsibility of the nubs 30 allows the substrate contact surface 28 to engage the substrate without a significant loss of depth of drive.

Referring now to FIGS. 9-13, an alternate embodiment of the present locator tip is generally designated 60. Shared components with the locator tip 10 have been designated with identical reference numbers. Generally, the locator tip 60 is designed for use on a dual-pronged workpiece contact element (WCE) 62 of a fastener driver or tool 64, which, aside from the WCE, is identical to the driver 14.

Included on the locator tip 60 is a tip body 66 being generally tubular in shape and having an insertion end 68 constructed and arranged for receiving tapered, prong or rod-like ends 70 of the WCE 62. In the preferred embodiment, one locator tip 60 is provided for each WCE end 70. Accordingly, the insertion end 68 and the body 66 together define a cavity 72 dimensioned to receive and tightly accommodate the end 70 in a friction fit. Since the ends 70 are rod-like in shape, the cavity 72 accordingly is generally cylindrical; however other shapes are contemplated depending on the construction of the end 70. To enhance the gripping engagement of the tip 60 on the WCE end 70, at least one locking formation 74 is provided on an inner surface of the cavity 72. In the preferred embodiment, the locking formations 74 take the form of compressible crush ribs extending axially in the cavity 72 and spaced approximately 90° from each other. However, other shapes and dispositions are contemplated, as long as a tight frictional engagement is achieved with the WCE end 70. Also, while the tips 60 are contemplated as being removable from the WCE ends 70, it is contemplated that they are also permanently installed using chemical adhesives, ultrasonic energy or the like. In addition, the cavity 72 includes a tapered closed end 76 for matingly engaging the WCE end 70.

Opposite the insertion end 68 is a substrate contact end 78 which is identical in configuration to the substrate contact end 26 of the locator tip 10. The corresponding description of the locator nubs 30 can be applied here as well. Accordingly, each locator tip 60 includes a castellated locator nub 30 having a plurality, and preferably four lugs 38 which are collapsible the distance "T" as discussed above up to a substrate contact surface 80 (FIG. 12).

While specific embodiments of the present collapsible protective tip for fastener driver workpiece contact element have been shown and described, it will be appreciated by those skilled in the art that changes and modifications may be made thereto without departing from the invention in its broader aspects and as set forth in the following claims.

What is claimed is:

1. A tip for a fastener driver workpiece contact element, comprising:

a body having an insertion end configured for receiving the workpiece contact element and a substrate contact end, said substrate contact end defining a plane;

a plurality of integral locator nubs projecting from a designated location on said substrate contact end, and all configured to be collapsible as a group along an axis perpendicular to said plane only up to said substrate contact end for maintaining a depth of drive adjustment of the fastener driver; and each of said plurality of locator nubs includes a plurality of laterally spaced collapsible lugs together forming a castellated construction.

2. The tip of claim 1 wherein each said lug has a generally convex surface.

3. The tip of claim 1 wherein said insertion end includes a cavity dimensioned for receiving the workpiece contact element and includes a half-pipe, snap-fit locking formation in said cavity for releasably grasping the workpiece contact element without the use of tools.

4. The tip of claim 3 wherein said at least one locking formation is integral with said body.

5. The tip of claim 1 wherein said at least one locator nub is disposed on said body along an axis which is generally transverse to said plane of said substrate contact end.

6. The tip of claim 1 wherein said plurality of locator nubs includes a pair of said designated locations, each having an associated plurality of said locator nubs, said designated locations being spaced apart to define a fastener driving location therebetween.

7. The tip of claim 1 wherein said body is generally tubular and said insertion end partly defines a generally cylindrical cavity.

8. The tip of claim 7 further including at least one locking formation in said cavity.

9. A tip for a rod-shaped fastener driver workpiece contact element, comprising:

a body having an insertion end configured for receiving the rod-shaped workpiece contact element, and a substrate contact end including a substrate contact surface defining a plane, said insertion end including a U-shaped, half-pipe cavity configured to matingly receive the workpiece contact element and including a locking formation configured for gripping the workpiece contact element in a snap-fit engagement without the use of tools;

a pair of spaced pod formations on said body generally adjacent said substrate contact surface, said pod formations defining a fastener driving location therebetween; and a plurality of spaced locator nubs projecting from each said substrate contact end, and configured to be collapsible along an axis perpendicular to the plane of the substrate contact end only up to said substrate contact end for maintaining a depth of drive adjustment of the fastener driver.

10. The tip of claim 9 wherein said pod formations and said substrate contact surface form a general "U"-shape when viewed from the workpiece.

11. The tip of claim 9 wherein said pod formations extend generally transversely to said substrate contact surface.

12. A tip for a fastener driver workpiece contact element having at least one rod-like end, comprising:

a generally tubular body having an insertion end configured for receiving a corresponding one of the ends of the workpiece contact element and a substrate contact end, said insertion end configured with at least one locking formation provided on an inner surface of the insertion end;

a plurality of spaced, axially collapsible locator nubs projecting from said substrate contact end and being collapsible as a group only up to said substrate contact end for maintaining a depth of drive adjustment of the fastener driver; and said plurality of locator nubs includes a plurality of laterally spaced collapsible lugs together forming a castellated construction.

13. The tip of claim 12 wherein said plurality of collapsible lugs includes four laterally snared lugs.

14. The tip of claim 12 wherein said at least one locking formation is one or more compressible crush ribs extending axially on the inner surface.

* * * * *